US007040910B2

(12) United States Patent
Nagata et al.

(10) Patent No.: US 7,040,910 B2
(45) Date of Patent: May 9, 2006

(54) PLUG TYPE CONNECTOR

(75) Inventors: Takayuki Nagata, Higashiosaka (JP); Yasuo Nakai, Nara (JP); Akihito Shichida, Yao (JP)

(73) Assignee: Hosiden Corporation, Yao (JP)

( * ) Notice: Subject to any disclaimer, the term of this patent is extended or adjusted under 35 U.S.C. 154(b) by 93 days.

(21) Appl. No.: 10/200,246

(22) Filed: Jul. 23, 2002

(65) Prior Publication Data

US 2003/0027450 A1 Feb. 6, 2003

(30) Foreign Application Priority Data

Aug. 2, 2001 (JP) ..... 2001-235127
Aug. 7, 2001 (JP) ..... 2001-238692

(51) Int. Cl.
*H01R 13/627* (2006.01)

(52) U.S. Cl. ..... 439/352; 439/353; 439/358

(58) Field of Classification Search ..... 439/350, 439/357, 856, 857, 924.1, 353, 352, 358
See application file for complete search history.

(56) References Cited

U.S. PATENT DOCUMENTS 5,340,329 A * 8/1994 Hirai ..... 439/357
5,356,304 A * 10/1994 Colleran ..... 439/358
5,486,117 A * 1/1996 Chang ..... 439/357
D424,519 S 5/2000 Feldt et al. ..... D13/133
6,071,141 A 6/2000 Semmeling et al. ..... 439/353
6,280,227 B1 * 8/2001 Terada et al. ..... 439/357
6,527,576 B1 * 3/2003 Omote ..... 439/326
6,764,331 B1 * 7/2004 Sloan ..... 439/352

FOREIGN PATENT DOCUMENTS

JP 6-19284 3/1994
JP 2001-176620 6/2001

* cited by examiner

*Primary Examiner*—Tho D. Ta
*Assistant Examiner*—Felix O. Figueroa
(74) *Attorney, Agent, or Firm*—Bacon & Thomas, PLLC

(57) ABSTRACT

A plug type connector, and more particularly a plug type connector having a locking function when the plug type connector is connected to a counter connector, coupling the plug type connector to the counter connector. A locking member is formed by a slender by a slender locking piece configured from a synthetic resin molded product, the operation load which is required for flexurally deforming the locking piece can be increasingly or decreasingly adjusted. The plug type connector comprises contact portions, the locking piece, a press operating member, and a backup member. The backup member has the function of adjusting the level of the operation load of the locking piece. In another embodiment, even when the locking member is made of metal, the enclosure of the counter connector is not shaved by a prying force applied on the counter connector, and hence the stability of the locked state can be enhanced. A locking member of the plug type connector is produced by bending a metal wire rod having a circular section shape.

5 Claims, 16 Drawing Sheets

PLUG TYPE CONNECTOR

BACKGROUND OF THE INVENTION

1. Field of the invention

The present invention relates to a plug type connector, and more particularly to a plug type connector having a locking function of, when the connector is connected to a counter connector, coupling the connector to the counter connector.

In the plug type connector of the invention, in the case where a locking member is formed by a slender locking piece configured by a synthetic resin molded product, the level of the operation load which is required for flexurally deforming the locking piece can be increasingly or decreasingly adjusted. In the case where a locking member is made of a metal, the enclosure of the counter connector is not shaved by a prying force applied on the counter connector, and hence the stability of the locked state can be enhanced. In the invention, moreover, a measure for enabling such a plug type connector to be easily miniaturized is taken.

2. Description of the Prior Art

Japanese Patent Application Laying-Open No. 2001-176620, Japanese Utility Model Application Laying-Open No. 6-19284, and U.S. Pat. No. 6,071,141 disclose plug type connectors of this type. In the plug type connectors, a spring plate configured by a sheet metal is employed as a locking member for exerting a locking function.

In the case where a spring plate configured by a sheet metal is used as a locking member, however, the following situation may often occur because the spring plate itself has the property of being easily bent. When the tip end of the spring plate protrudes in front of an enclosure of the plug type connector, the exposed portion of the tip end of the spring plate accidentally interferes with any other article to be deformed.

In a plug type connector using a spring plate configured by a sheet metal, moreover, the following situation may often occur. When a prying force is applied during a work of connecting or disconnecting the plug type connector from a counter connector, the enclosure (housing, case) of the counter connector is shaved by an edge of the sheet metal spring plate. When such a situation repeatedly occurs as a result of frequent repetition of connection and disconnection, the position of an engaged portion between the sheet metal locking member and the counter connector is changed, thereby causing a problem in that the stability of the locked state is impaired.

In order to solve the problem, it is contemplated to use a slender locking piece configured as a synthetic resin molded product which has the property of being hardly bent relative to a sheet metal spring plate, as a locking member. In the case where a slender locking piece configured as a synthetic resin molded product which is hardly bent is used as a locking member, even when the tip end of the locking member protrudes in front of an enclosure of the plug type connector to be exposed therefrom, the exposed portion is hardly deformed. U.S. Pat. No. Des. 424,519 discloses an example in which a locking member is configured by a resin molded product.

When, in order to adjust the level of a load required for flexural deformation in such a slender locking piece made of a synthetic resin, a usual technique is employed in which the length of the locking piece is changed to use the principle of the lever that is exerted by the locking piece itself, the change of the length of the locking piece affects the whole size of the plug type connector. When the load required for flexural deformation (deformation load) is to be reduced, therefore, the locking piece must be prolonged, so that the overall size of the plug type connector is increased. In a connector in which a locking member is formed as a resin molded product, when the strength required for the locking member is to be ensured, the size of the locking member itself is increased. This causes the appearance of the plug type connector to be changed, and, particularly, the width of the plug type connector to be prolonged, thereby producing a problem in that miniaturization of a plug type connector is impaired.

SUMMARY OF THE INVENTION

It is an object of the invention to provide a plug type connector in which, in the case where a locking member is formed as a slender locking piece configured from a synthetic resin molded product, even when the tip end of the locking piece protrudes in front of an enclosure of the plug type connector to be exposed therefrom, accidental deformation does not occur, and the level of the operation load required for flexurally deforming the locking piece can be increasingly or decreasingly adjusted without changing the deformation load.

It is another object of the invention to provide a plug type connector in which the level of the operation load required for flexurally deforming a slender locking piece configured from a synthetic resin molded product can be increasingly or decreasingly adjusted without affecting the overall size of the plug type connector.

It is a further object of the invention to economically provide a plug type connector in which the locked state where a slender locking piece configured from a synthetic resin molded product is engaged with an engagement portion of a counter connector which can be set to a half locked state or to a full locked state by using only an economical synthetic resin molded product.

It is another object of the invention to provide a plug type connector in which a metal wire rod is basically used as a locking member, and the locking member is produced by bending the metal wire rod, whereby, even when a prying force is applied during the process of connecting or disconnecting the plug type connector from a counter connector, the enclosure of the counter connector is prevented from being shaved, so that the stability of the locked state can be enhanced.

It is another object of the invention to provide a plug type connector in which the dimension of the locking member in the width direction of the plug type connector can be reduced to a very small level, thereby allowing the connectro to be easily miniaturized.

It is a further object of the invention to provide a plug type connector in which, in a case such as that where a prying force is applied during the process of disconnecting the plug type connector from a counter connector connected thereto, the locking member is disengaged before the counter connector is broken, thereby preventing the counter connector from being broken.

It is another object of the invention to provide a plug type connector in which the dimension of the locking member, in the width direction of the plug type connector, can be reduced, thereby allowing the connector to be easily miniaturized.

The plug type connector of the invention, comprises according to one embodiment: a contact nortion which is to be electrically connected to a counter connector; an elastic locking piece which is placed on each of both sides of the contact portion, and which is to be engaged with and disengaged from an engagement portion of the counter connector; and a press operating member which presses the locking piece positioned in a position of engagement with the engagement in a direction along which the locking piece approaches the contact portion, whereby the locking piece is displaced against resiliency to a position of disconnection from the engagement portion.

In the plug type connector, the locking piece engaged with the engagement portion of the counter connector can be disconnected from the engagement portion by operating the press operating member. When the operating force acting on the press operating member is released, the locking piece can be returned by its resiliency to the position of engagement with the engagement portion of the counter connector.

In the invention, the connector has: the locking piece configured from a synthetic resin molded product having an elastic slender arm portion that is flexurally deformable, and a latch portion that is to be engaged with and disengaged from the engagement portion by means of a flexural deformation of the arm portion; and a backup member which is placed behind the arm portion, and which has resiliency for adjusting a level of an operation load that is required for supporting and flexurally deforming the arm portion When this configuration is employed, the locking piece uses a synthetic resin molded product, and the synthetic resin molded product has the property of being hardly bent relative to a metal. Even when the tip end of the locking piece configured from a synthetic resin molded product protrudes in front of an enclosure of the plug type connector to be exposed therefrom, therefore, accidental deformation does not occur.

Furthermore, the level of the operation load that is required for flexurally deforming the arm portion of the locking piece can be adjusted simply by adjusting the degree of the resilient force of the backup member. Therefore, the level of a load which is required to be applied to the arm portion when the latch portion of the locking piece is to be engaged with the engagement portion of the counter connector, and that of a load which is required to be applied to the arm portion when the latch portion of the locking piece is to be disconnected from the engagement portion of the counter connector can be adjusted simply by adjusting the degree of the resilient force of the backup member. This means that an increase or decrease adjustment of the deformation load or the operation load does not require the necessity to adjust the length of the arm portion of the locking piece. Therefore, the levels of the loads can be changed without changing the whole size of the plug type connector. In the case where the plug type connector is forcibly pulled under the situation where the plug type connector is coupled to the counter connector via the locking piece, a half locked state where the connectors can be easily disengaged from each other, or a full locked state where the connectors cannot be disengaged from each other can be readily produced simply by adjusting the degree of the resilient force of the backup member.

This function can be performed also by employing a configuration in which a deformation load which can flexurally deform the arm portion can be set to be smaller than the operation load; by selecting a thickness of the arm portion, and an insufficiency of the deformation load with respect to the operation load is compensated by a resilient force of the backup member.

In the invention, a plate piece-like synthetic resin molded product, preferably, a plate piecelike elastomer is used in the backup member.

As described above, the backup member has the function of adjusting the level of the operation load that is required for supporting and flexurally deforming the arm portion of the locking piece. From only this point of view, it is possible to use a sheet metal spring plate or a metal coil spring. When a sheet metal spring plate or a metal coil spring is used, however, a relatively large installation space is required, and moreover the spring itself is expensive, with the result that the size and cost of the plug type connector tend to be increased. By contrast, when a plate piecelike synthetic resin molded product is used in the backup member as in the invention, the required installation space is small, the cost is low, and hence the size and cost of the plug type connector can be easily reduced. When a plate piece-like elastomer is used in the backup member, particularly, there is an advantage that the backup member can be improved in durability and resiliency as compared with the case where a synthetic resin molded product is used.

In the invention preferably, the degree of the resilient force of the backup member is defined by adjusting an area of a contact surface with respect to the arm portion. According to the configuration, in the case where the backup member is produced by using a plate piece-like synthetic resin molded product or elastomer, it is required only to form a large synthetic resin or elastomer sheet, cut the sheet into an adequate size, and then use the sheet as the member. Therefore, the backup member can be easily mass-produced. This contributes to a further reduced cost.

In the invention preferably, the contact portion and the locking piece are accommodated in a common enclosure, the press operating member is attached to each of lateral sides of the enclosure, and the enclosure comprises: a wall face which overlaps with a back face of the backup member; and a concave or convex backup member holding portion to which the backup member is to be fitted or detached.

According to the configuration, the backup member can be placed so as to overlap with the wall face, and hence the backup member can surely perform the function of adjusting the operation load. Moreover, the backup member can be fitted into or detached from the concave or convex backup member holding portion. When the degree of the resilient force of the backup member is to be adjusted, therefore, backup members of different areas of the contact surface can be replaced with each other by an operation of fitting to the backup member holding portion. This is useful for promoting mass-production of the plug type connector.

As described above, according to the invention, even when the tip end of the locking piece protrudes in front of the enclosure of the plug type connector to be exposed therefrom, accidental deformation hardly occurs. Moreover, the level of the operation load reqyired for flexurally deforming the locking piece can be adjusted without changing the deformation load possessed by the locking piece itself. Therefore, the level of the operation load required for flexurally deforming the locking piece can be adjusted without affecting the whole size of the plug type connector. As a result, the plug type connector can be easily miniaturized irrespective of the level of the operation load.

Furthermore, a plug type connector can be economically provided in which the locked state where the locking piece is engaged with the engagement portion of the counter connector can be set to a half locked state or to a full locked state by using only an economical synthetic resin molded product, and without using a metal part such as a sheet metal spring plate or a metal coil spring.

The plug type connector of the invention comprises: a contact portion which is to be electrically connected to a counter connector; and an elastic locking member ber which is placed on each of both sides of the contact portion, and which is to be engaged with an engagement portion of the counter connector in accordance with connection of the contact portion with the counter connector.

In the invention the locking member is produced by bending a metal wire rod having a circular section shape.

According to the invention, the metal wire rod forming the locking member has a circular section shape, and hence the locking member has no edge. Even when a prying force is applied during a work of connecting or disconnecting the plug type connector from the counter connector, therefore, a situation where the enclosure of the counter connector is shaved by an edge of the locking member does not occur. Since the locking member which is produced by bending a metal wire rod can be easily made smaller than that which is produced by using a plate spring or a resin molded product, miniaturization of the plug type connector comprising the locking member which is produced by using a metal wire rod is easily expedited. When the locking member is produced by bending a metal wire rod, the locking member is lower in cost than that which is produced by using a plate spring or a synthetic resin molded product because the metal wire rod itself is economical and a sophisticated process is not necessary. This is useful for reducing the cost of the plug type connector.

In the invention the following configuration can be employed. The locking member comprises: an arm portion which is accommodated in an enclosure, in which a tip end portion protrudes in front of the enclosure, and which is elastically deformable; and a mountain-like engaged portion which is disposed on a tip end of the arm portion. The mountainlike engaged portion has: a front inclined part which is pressed from an outside against the engagement portion of the counter connector to cause the engaged portion to slide over the engagement portion to override the engagement portion and reach an inner side of the engagement portion, while elastically defonuing the arm portion; and a rear inclined part which, when the engaged portion overrides the engagement portion and reaches the inner side of the engagement portion, cooperates with a butting surface of the enclosure to clampingly press the engagement portion. The front inclined part and the rear inclined part are inclined in opposite directions.

In the invention, the mountain-like engaged portion may be configured so that the front inclined part and the rear inclined part are linearly formed, or so that the front inclined part and the rear inclined part are formed into a continuous arcuate shape. In the invention the rear inclined part has an inclination which, when the enclosure is pulled in a direction along which the enclosure is separated from the engagement portion in a state where the rear inclined part cooperates with the butting surface to clampingly press the engagement portion, allows the rear inclined part to slide over the engagement portion to guide the engaged portion to an outside of the engagement portion while elastically deforming the arm portion.

According to the configuration, when the plug type connector is to be connected to the counter connector, it is requested to perform only an operation of pressing from the outside the mountain-like engaged portion against the engagement portion of the counter connector. As a result, the engagement portion of the counter connector is clampingly pressed by means of cooperation of the rear inclined part of the engaged portion and the butting surface of the enclosure, and hence the counter connector and the plug type connector are connected to each other in a rattlefree condition. This function is performed more satisfactorily because the locking member is produced by using a metal wire rod, and the rear inclined part of the engaged portion exerts the elasticity of the wire rod. When the plug type connector is to be disconnected from the counter connector, it is requested only to pull the enclosure of the plug type connector. When a prying force is applied to the plug type connector and the counter connector which are connected to each other, the front and rear inclined parts of the engaged portion, the arm portion, and the like are deformed because of the elasticity of the metal wire rod itself forming them, to function so that the engaged portion is disengaged from the engagement portion while absorbing the prying force. Therefore, a situation where the enclosure of the plug type connector or the counter connector is broken is prevented from occurring.

In the invention, preferably, the enclosure is formed into a flat shape, the mountain-like engaged portion of the locking member is placed in a form in which the engaged portion protrudes from the arm portion in a thickness direction of the enclosure, and the enclosure has a guide face which restricts a direction of the elastic deformation of the arm portion to the thickness direction of the enclosure.

According to the configuration, in the total width of the enclosure, the width of the engaged portion is limited to the thickness of the metal wire rod forming the engaged portion, and the direction of the swing of the engaged portion due to the elastic deformation of the arm portion is restricted only to the thickness direction of the enclosure. Therefore, it is not required to include the swing amplitude of the engaged portion in the width of the enclosure. Consequently, as compared with the connector which has been described in the beginning of the specification, and in which the locking member is formed by a resin molded product, the width of the enclosure can be reduced and miniaturization of the enclosure can be easily expedited.

In the invention, it is possible to employ a configuration in which, the arm portion is formed by a pair of parallel linear portions, the rear inclined part of the mountain-like engaged portion is continuous to a tip end of one of the linear portions, and the front inclined part of the engaged portion is continuous to a tip end of the other linear portion.

According to the configuration, even when an economical thin metal wire rod which is soft and elastic to be easily bent is used as the metal wire rod, the pair of parallel linear portions forming the arm portion can be provided with elasticity of an adequate degree.

In the invention, preferably, the locking member is configured by a pair of bent wire rods each having the arm portion and the mountain-like engaged portion, and the wire rods are placed to overlap each other in the width direction of the enclosure in a state where the mountain-like engaged portions protrude in opposite directions.

In this case, preferably, between the pair of bent wire rods, the linear portions of the other side are placed to overlap each other in the width direction of the enclosure. According to the configuration, the plug type connector can be connected with the counter connector, while the engaged portions of the pair of bent wire rods are engaged with two engagement portions of the counter connector. Therefore, the connection stability can be correspondingly improved.

As described above, according to the other invention a metal wire rod having a circular section shape is used as the locking member, and, even when a prying force is applied during a work of connecting or disconnecting the plug type connector from the counter connector, therefore, a situation where the enclosure of the counter connector is shaved does not occur. Therefore, the stability of the locked state is enhanced. Since a metal wire rod is used as the locking member, miniaturization of the plug type connector is easily expedited. Even when a prying force is applied during a work of disconnecting the plug type connector from a counter connector connected thereto, the locking member is disengaged before the counter connector is broken, thereby preventing the counter connector from being broken. Moreover, according to the invention, the locking member can be economically produced, and hence the cost of the plug type connector can be easily reduced.

DETAILED DESCRIPTION OF THE PREFERRED EMBODIMENT

FIGS. 1 to 5 correspond to the plug type connector of the invention.

Figure 1:
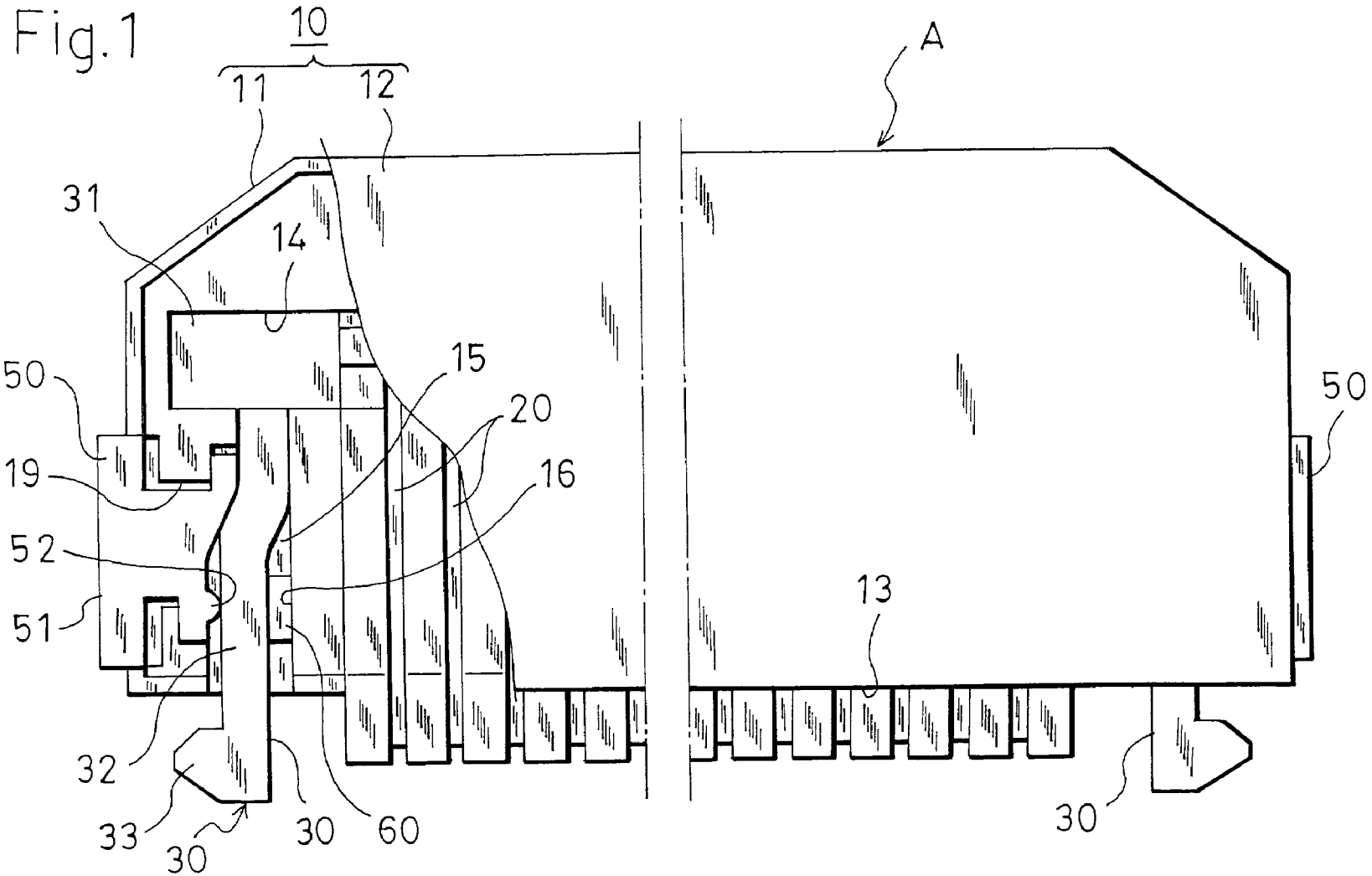
FIG. 1 is a partially cutaway plan view showing the plug type connector of the invention, with being partly omitted.

As shown in FIG. 1, the plug type connector A has a laterally oblong flat enclosure 10 which is formed by a base portion 11 and a cover portion 12 combined with the base portion 11. In the enclosure 10, many contact portions 20 which form contacts, and which are made of a sheet metal, locking pieces 30, 30 which are placed on both sides of a row of the contact portions 20, respectively, press operating members 50, 50 which are attached to the lateral sides of the enclosure 10, respectively, and a backup member 60 are disposed. The contact portions 20 . . . and the locking pieces 30, 30 protrude in front of the front end face 13 of the enclosure 10.

Figure 2:
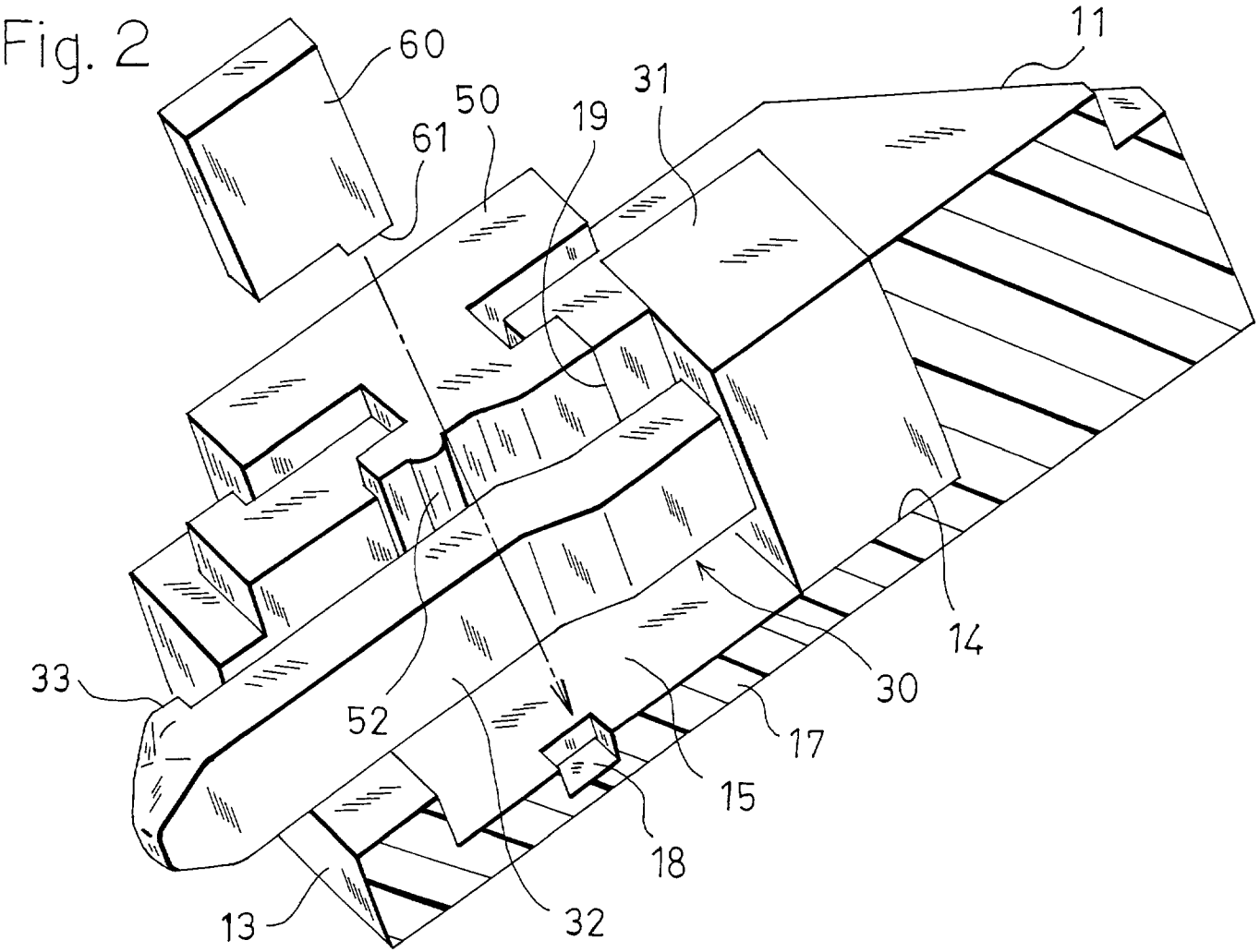
FIG. 2 is a schematic perspective view showing main portions, with being cutaway.

As shown in FIGS. 1 and 2, each of the locking pieces 30 comprises: an attachment portion 31 which is fitted into a rectangular recess 14 of the base portion 11 to be immovably held therein; an arm portion 32 which forward elongates from the attachment portion 31 in a longitudinally oblong recess 15 that is formed continuously to the recess 14; and a protruding latch portion 33 which is disposed on the front end of the arm portion 32 so as to be projected outward in the lateral direction. The latch portion 33 is formed into a tapered shape. The locking piece 30 is configured by an integral molded product of a synthetic resin, and the arm portion 32 is provided with flexurally deformable elasticity characteristic to the synthetic resin. By contrast, the latch portion 33 has a thickness which prevents the portion from being easily chipped or broken by interference or collision with another article.

The backup member 60 is formed by a plate piece-like elastomer, and has resiliency. In the backup member 60, the rear face overlaps a wall face 16 of the base portion 11, and a protrusion piece 61 formed in the lower end of the backup member 60 is fitted into a recessed backup member holding portion 18 which is formed in the lower wall 17 of the base portion 11. Therefore, the backup member 60 is positioned at a position where the member overlaps the wall face 16, by fitting of the protrusion piece 61 and the backup member holding portion 18. The surface of the backup member 60 which is positioned in this way overlaps the back face of the arm portion 32 of the locking piece 30 in an unloaded condition.

The press operating members 50 are loosely fitted into recesses 19 which are formed in lateral end portions of the base portion 11, respectively, so as to be laterally extractable and retractable only in a constant range. The outer end face of each of the members is formed as a press operating face 51. A press working portion 52 which is opposed to the arm portion 32 of the locking piece 30 is formed on an inner end portion of the member.

The locking pieces 30, the backup members 60, and the press operating members 50 are placed respectively in lateral end portions of the enclosure 10 in symmetrical relationships.

Figure 3:
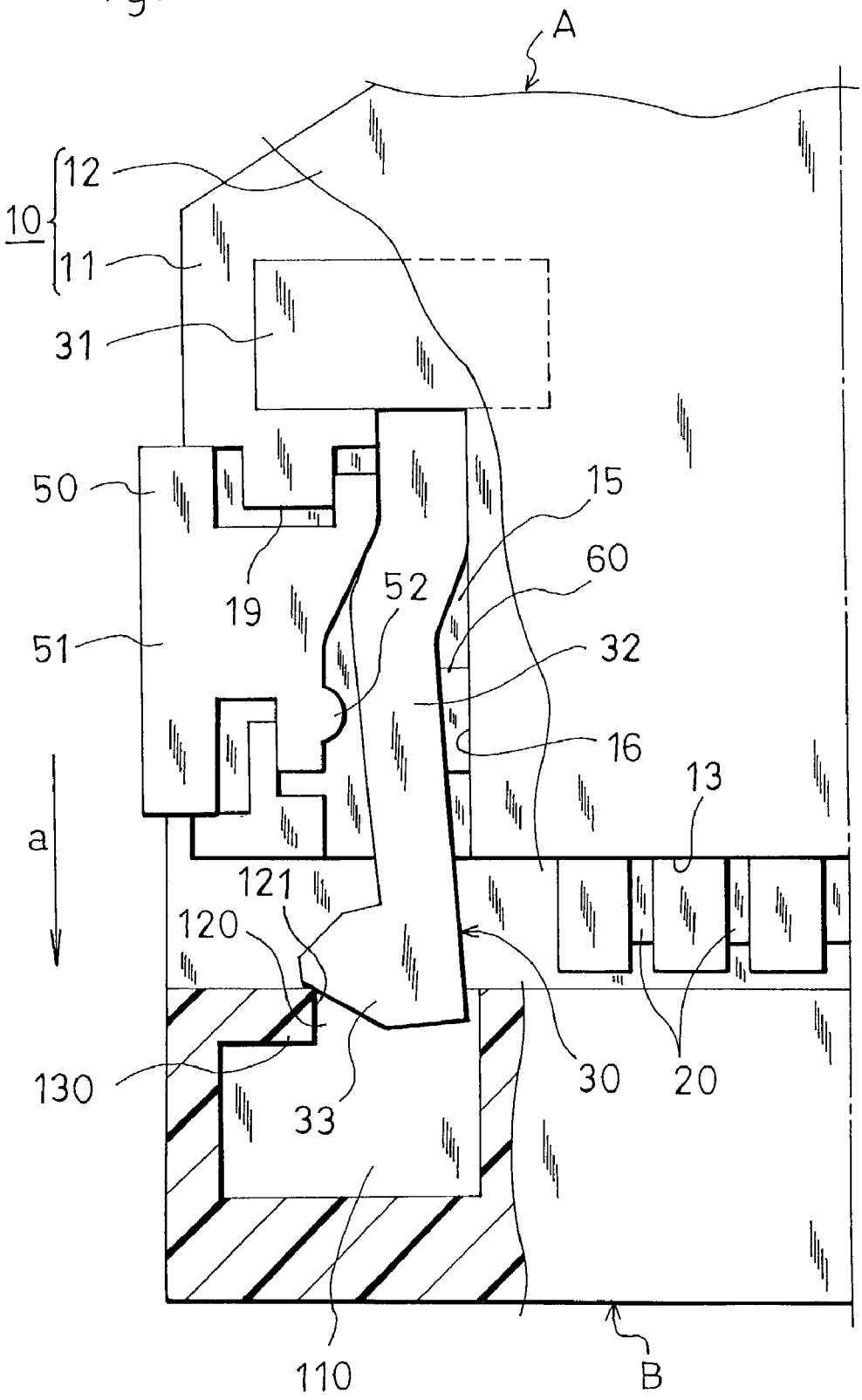
FIG. 3 is a partially cutaway partial plan view showing an initial stage where the plug type connector is coupled to a jack type connector.
Figure 4:
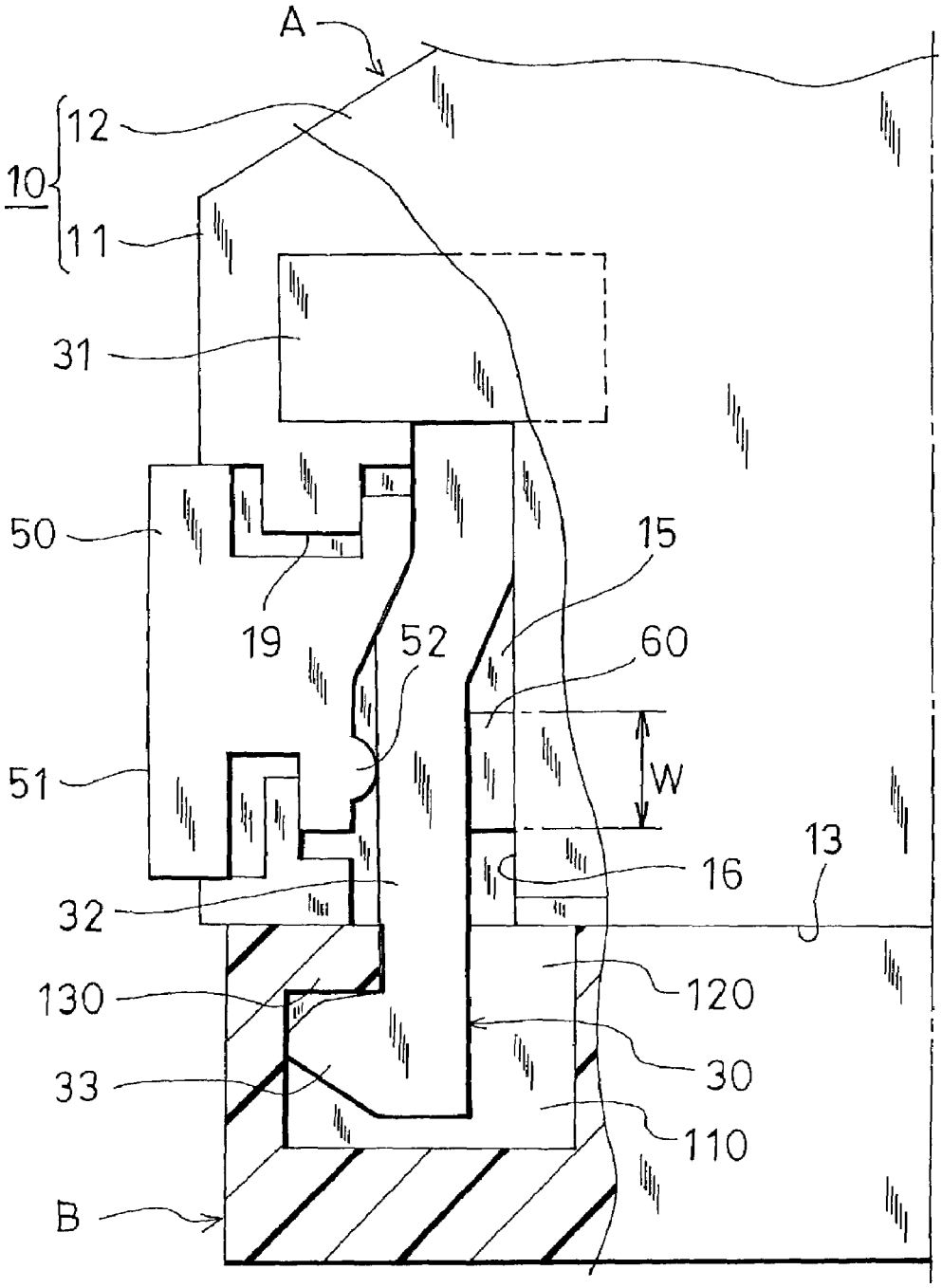
FIG. 4 is a partially cutaway partial plan view showing a stage where the plug type connector is coupled to the jack type connector.
Figure 5:
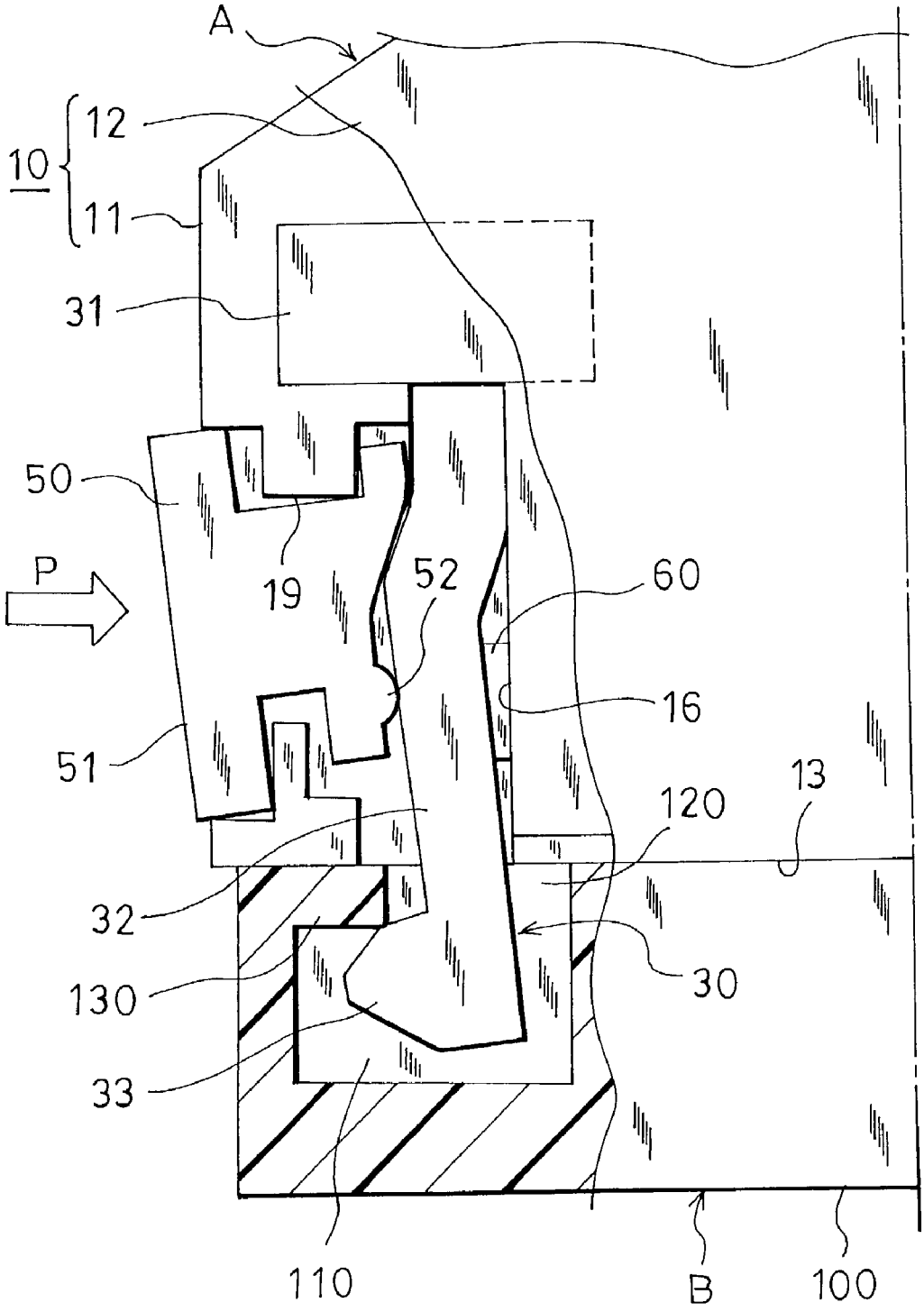
FIG. 5 is a partially cutaway partial plan view showing a stage where the plug type connector is extracted from the jack type connector.

FIGS. 3 to 5 show a jack type connector B which is the counter connector.

The illustrated jack type connector B has a recessed portion 110 into which the latch portion 33 of the locking piece 30 is to be fitted, in each of lateral end portions of a laterally oblong hollow enclosure 100; and an engagement portion 130 which is to be engaged with and disengaged from the latch portion 33 of the locking piece 30, in an edge of an opening 120 of the recessed portion 110. Between the right and left recessed portions 110, an opening into which the row of the contact portions 20 is to be inserted, and terminals (not shown) which are to be in contact with the row of the contact portions 20 are disposed.

Next, the operation will be described with reference to FIGS. 3 to 5. In the following description of the operation, only the locking piece 30, the backup member 60, and the press operating member 50 on one side will be described. The locking piece, the backup member, and the press operating member 50 on the other side operate in parallel with the members on the one side, and hence their description is omitted.

When the plug type connector A is opposed to the jack type connector B and the row of the contact portions 20 is inserted into the opening of the jack type connector B as indicated by the arrow a in FIG. 3, the tapered latch portion 33 of the locking piece 30 is pressingly inserted as indicated by the arrow a in a state where the latch portion butts against the edge 121 of the opening 120. In accordance with the pressing of the edge 121 on the latch portion 33 in the laterally inward direction, the arm portion 32 is flexurally deformed in the laterally inward direction while compressing the backup member 60 against the resilient force of the member. This causes the latch portion 33 to override the edge 121 of the opening 120. When the latch portion 33 overrides the edge 121 of the opening 120 in this way, the arm portion 32 is returned to its initial position by the elasticity of the arm portion 32 itself and the resilient force of the backup member 60, so that the latch portion 33 is engaged with the engagement portion 130 as shown in FIG. 4. The row of the contact portions 20 is inserted into the jack type connector B and then contacted with the terminals of the connector. In this state, the plug type connector A is coupled with the jack type connector B by the engagement between the latch portion 33 and the engagement portion 130. This is the locked state.

In the embodiment, a synthetic resin molded product is used as the locking piece 30. Even when the latch portion 33 of the locking piece 30 protrudes in front of the enclosure 10 to be exposed therefrom, or when the latch portion 33 accidentally interferes with any other article to impact thereagainst, therefore, a situation where the latch portion 33 is bent, chipped, or broken hardly occurs.

Next, the press operating member 50 is pressingly inserted by a finger of the hand as indicated by the arrow P of FIG. 5. The press working portion 52 presses the arm portion 32 of the locking piece 30 in the laterally inward direction. Therefore, the arm portion 32 is flexurally deformed in the laterally inward direction against the elasticity of the portion and the resilient force of the backup member 60. In accordance with this deformation, the latch portion 33 is displaced from the position of engagement with the engagement portion 130, toward the inner side in the lateral direction. When the latch portion 33 is disconnected from the engagement portion 130 in this way, the coupling state of the plug type connector A and the jack type connector B is cancelled, and hence the plug type connector A can be pulled out from the jack type connector B. When the plug type connector A is pulled out from the jack type connector B, the arm portion 32 is returned to the initial position by the elasticity of the arm portion 32 itself and the resilient force of the backup member 60.

As described above, the latch portion 33 is formed into a tapered shape. When the latch portion 33 is pressingly inserted while being pressed against the edge 121 of the opening 120 as shown in FIG. 3, therefore, the latch portion 33 is caused by the guiding function of the surface of the latch portion 33 to override the edge 121 while flexurally deforming the arm portion 32, and then fitted into the recessed portion 110 as shown in FIG. 4. When the press operating member 50 is pressed to slightly displace the latch portion 33 in the laterally inward direction as shown in FIG. 5 and the plug type connector A is then pulled, the latch portion 33 is caused by the guiding function of the surface of the latch portion 33 to override the edge 121 while flexurally deforming the arm portion 32, and then disconnected from the engagement portion 130.

In the embodiment, the degree of the pressing force which is required for pressingly inserting the latch portion 33 of the locking piece 30 into the recessed portion 110 and engaging the latch portion with the engagement portion 130 (hereinafter, such a force is referred to as latch portion pressing force) is defined by the degree of the elasticity of the arm portion 32 and that of the resilient force of the backup member 60. This is similarly applicable also to the operating force of the press operating member 50 which is exerted when the press operating member 50 is pressingly inserted to flexurally deform the arm portion 32 (hereinafter, such a force is referred to as operating member operating force).

In the embodiment described above, a load required for flexurally deforming the arm portion 32 against the elasticity of the arm portion itself is defined as deformation load, and that required for flexurally deforming the arm portion 32 against the elasticity of the arm portion itself and the resiliency of the backup member 60 is defined as operation load. As the operation load is made larger, the latch portion pressing force becomes larger, and the operating member operating force is larger. By contrast, as the operation load is made smaller, the latch portion pressing force becomes smaller, and the operating member operating force is smaller. Therefore, the operation load can be adjusted simply by changing the resiliency of the backup member 60 while the elasticity of the arm portion 32 is unchanged. The degree of the resilient force of the backup member 60 can be controlled by adjusting the area of a contact surface of the backup member 60 with respect to the arm portion 32. The area of the contact surface is changed simply by changing the width W of the backup member 60 shown in FIG. 4.

In the embodiment, therefore, the operation load can be adequately adjusted simply by replacing the plate piece-like backup member 60 with another one to change the size of the member, and without changing the length of the arm portion 32 of the locking piece 30. While the deformation load is reduced by thinning the arm portion 32, the insufficiency of the operation load can be compensated by the resilient force of the backup member 60. Therefore, a half locked state where, when the plug type connector A is forcibly pulled under the situation where the plug type connector A is coupled to the jack type connector B as shown in FIG. 4, the connectors A, B are disengaged from each other, or a full locked state where the connectors A, B are not disengaged from each other can be readily produced simply by adjusting the degree of the resilient force of the backup member 60.

In the embodiment described above, a plate piece-like elastomer is used in the backup member 60. Alternatively, the member may be formed by a synthetic resin molded product as seen in usual synthetic rubber which is more economical than elastomer. In order to enhance the durability and obtain preferable resiliency, it is desirable to use elastomer.

In the embodiment, each of the locking pieces 30 is configured by an integral molded product of a synthetic resin, the backup member 60 is formed by a plate piece-like elastomer, and the operation load can be adjusted by replacing only the backup member 60 and without replacing the locking pieces 30. Therefore, plug type connectors of different operation loads can be easily mass-produced.

FIGS. 6 to 16 correspond to the plug type connector of the invention of claims 7 to 13. In the description with reference to FIGS. 6 to 16, elements which are identical or correspond to those of FIGS. 1 to 5 are denoted by the same reference numerals.

Figure 6:
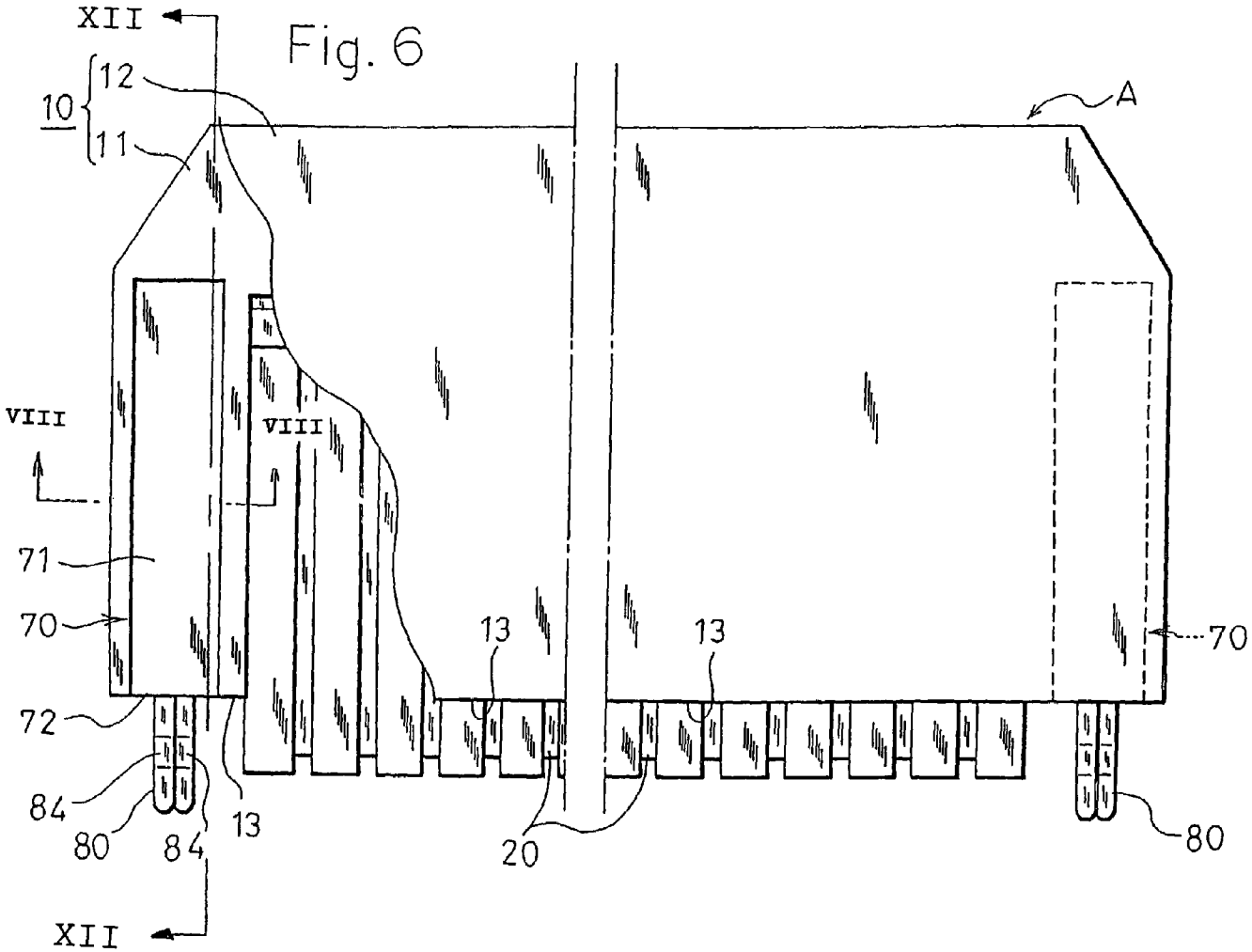
FIG. 6 is a partially cutaway plan view showing the plug type connector of another embodiment of the invention, with being partly omitted.

As shown in FIG. 6, the plug type connector A comprises, in the laterally oblong flat enclosure 10 which is formed by the base portion 11 and the cover portion 12 combined with the base portion, the many contact portions 20 which form contacts, and which are made of a sheet metal, and lock units 70, 70 which are placed on both sides of the row of the contact portions 20, respectively. The contact portions 20 . . . , and locking members 80, 80 which are disposed on the lock units 70, 70 protrude in front of the front end face 13 of the enclosure 10. The front end face of a case 71 of each of the lock units 70 is flush with the front end face 13 of the enclosure 10, and is formed as a butting surface 72 of the enclosure.

Figure 7:
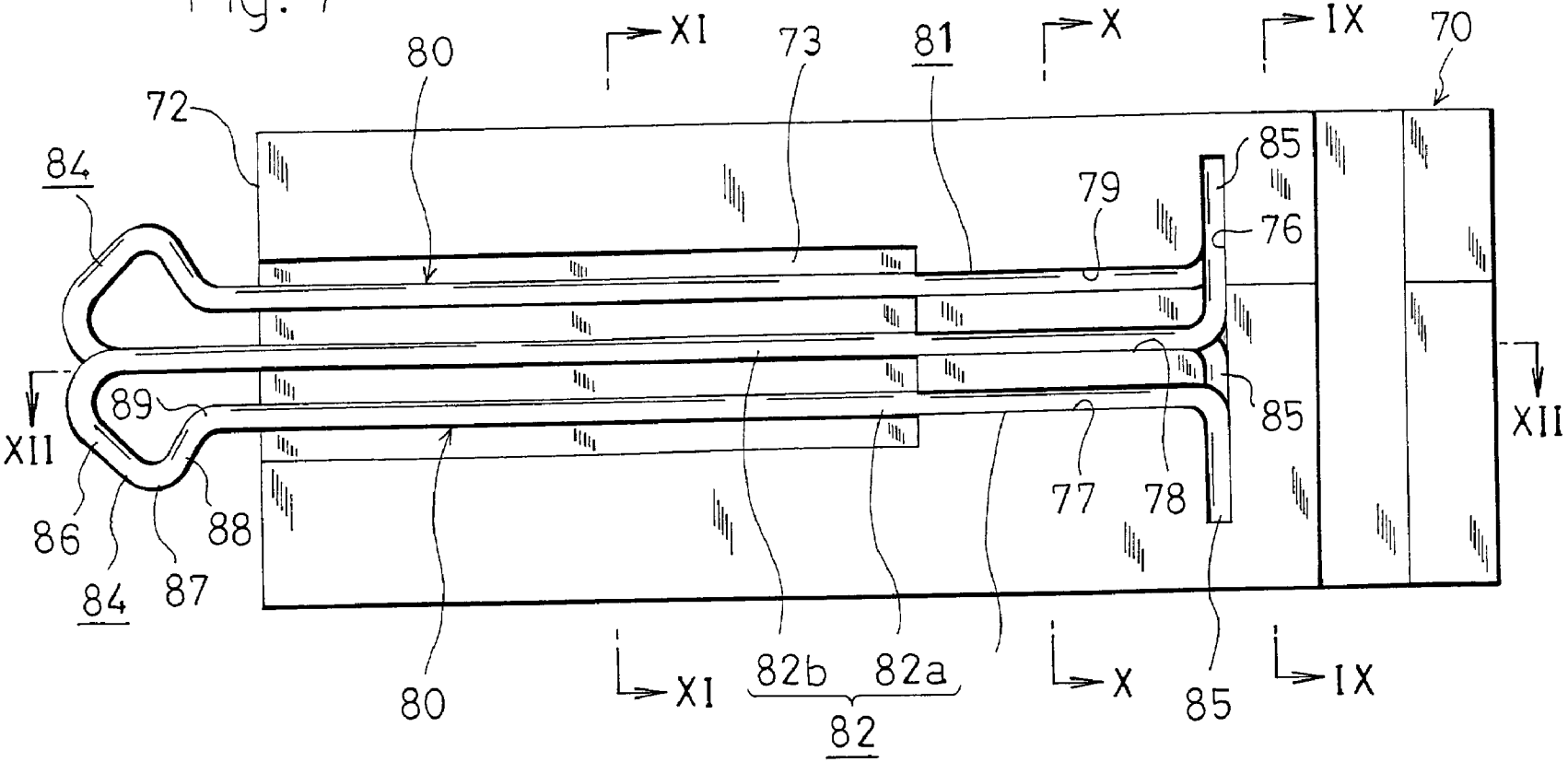
FIG. 7 is an enlarged vertical section view of a lock unit.
Figure 8:
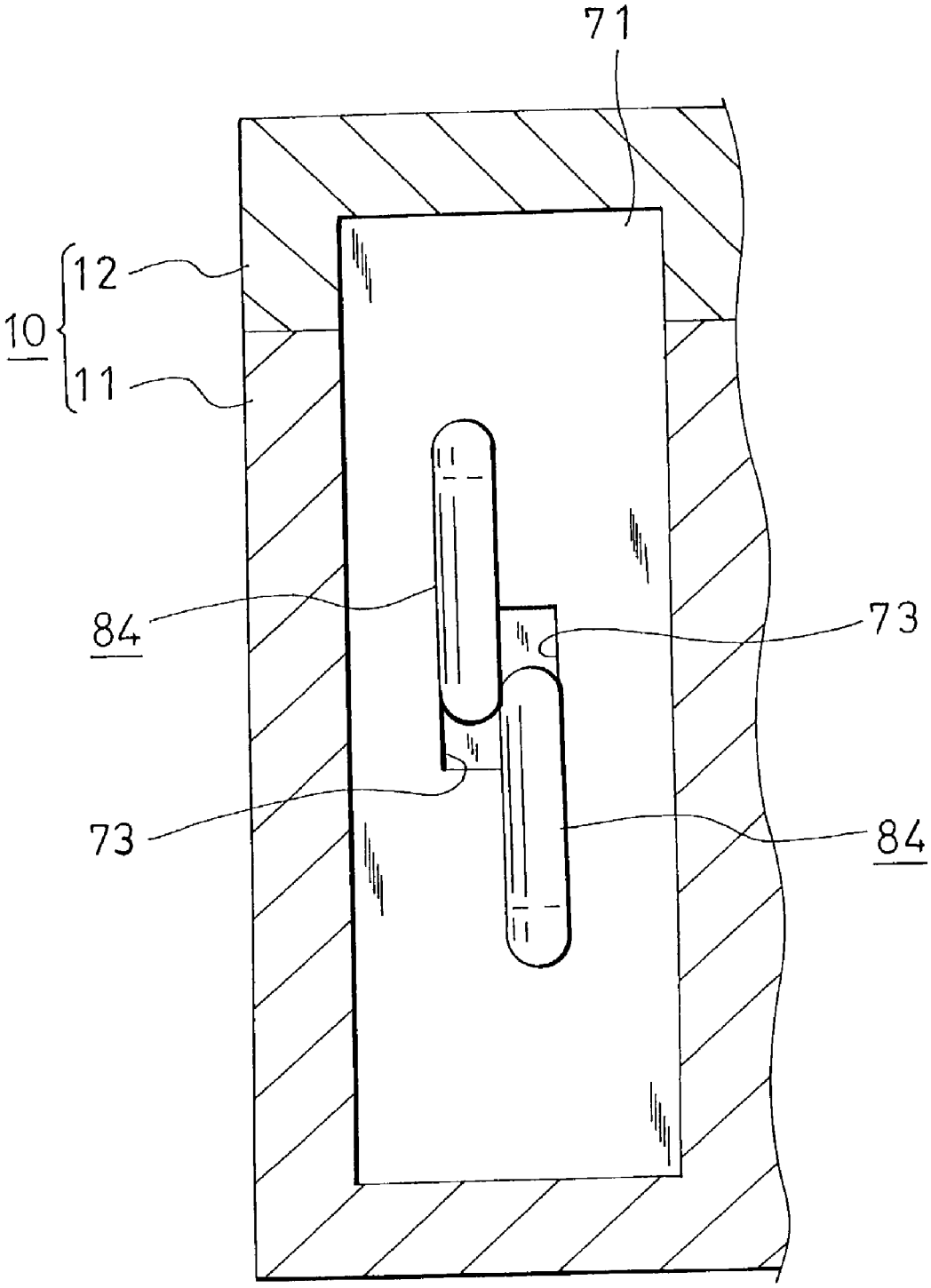
FIG. 8 is an enlarged section view taken along the line VIII—VIII of FIG. 6.
Figure 9:
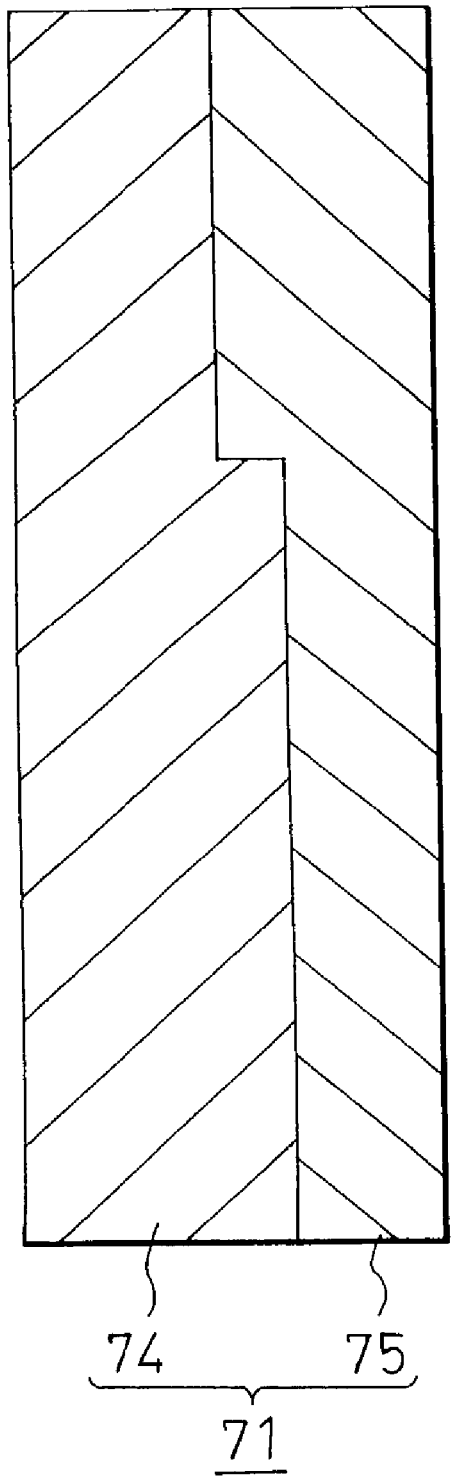
FIG. 9 is an enlarged section view taken along the line IX—IX of FIG. 7.
Figure 12:
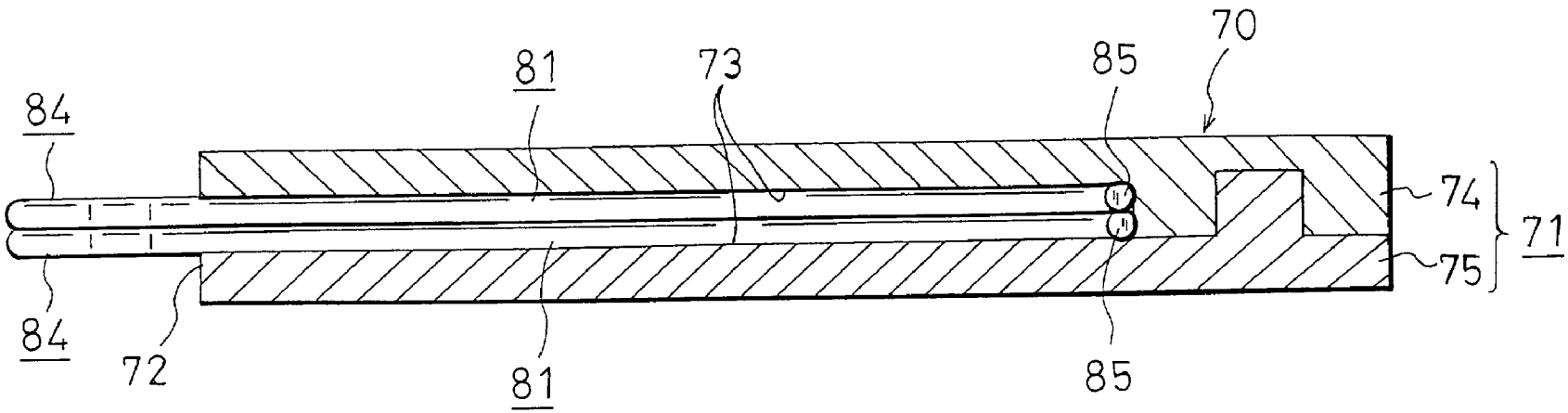
FIG. 12 is a section view taken along the line XII-XII of FIG. 6.

As seen from FIGS. 7 and 12, each of the locking members 80 comprises a pair of bent wire rods 81, 81 which are produced by bending a thin metal wire rod having a circular section shape. Each of the bent wire rods 81 integrally comprises: a pair of parallel long linear portions 82*a*, 82*b* forming an arm portion 82; a mountain-like engaged portion 84 which is connected to the tip ends of the linear portions 82*a*, 82*b*; and latch portions 85, 85 which are bendingly formed in basal areas of the linear portions 82*a*, 82*b*, respectively. The mountain-like engaged portion 84 comprises a linear front inclined part 86 which is forward and downward inclined, and a rear inclined part 88 which is forward and upward inclined and smoothly continuous to the front inclined part 86 via a curved part 87. The rear inclined part 88 is smoothly continuously connected to the tip end of the one linear portion 82*a* via a curved part 89, and the front inclined part 86 is smoothly continuously connected to the tip end of the other linear portion 82*b*.

By contrast, as seen from FIGS. 9 to 12, the case 71 of each of the lock units 70 has a split structure which is formed by laterally combining a base 74 with a cover 75. As shown in FIG. 7 or FIGS. 10 to 12, in the case 71, formed are: a latch groove 76 which elongates in the longitudinal direction; three retention grooves 77, 78, 79 which forward elongate in parallel from the latch groove 76; and a flat guide face 73 which is formed by a recessed face formed in front of the retention grooves 77, 78, 79.

Figure 10:
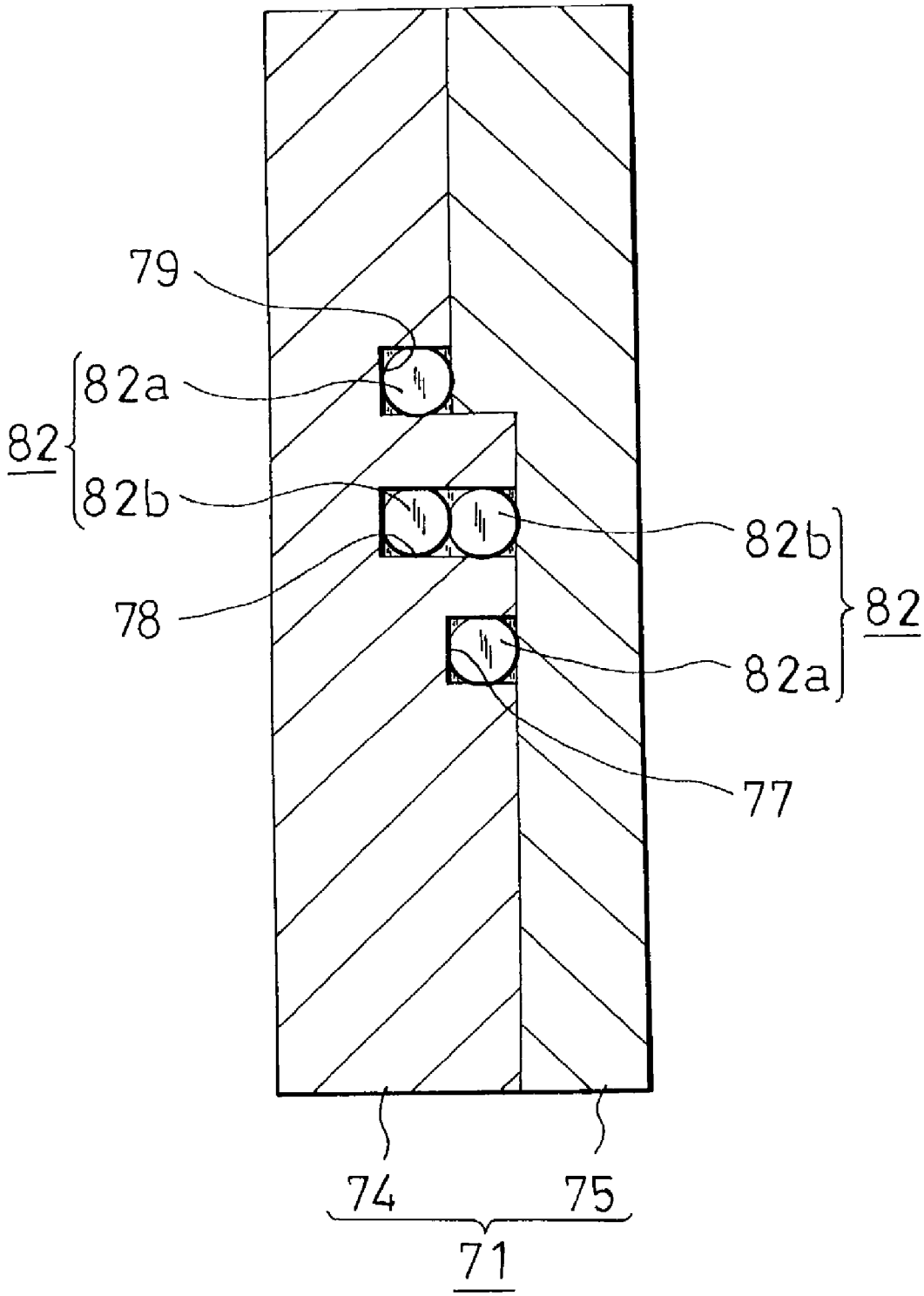
FIG. 10 is an enlarged section view taken along the line X—X of FIG. 7.
Figure 11:
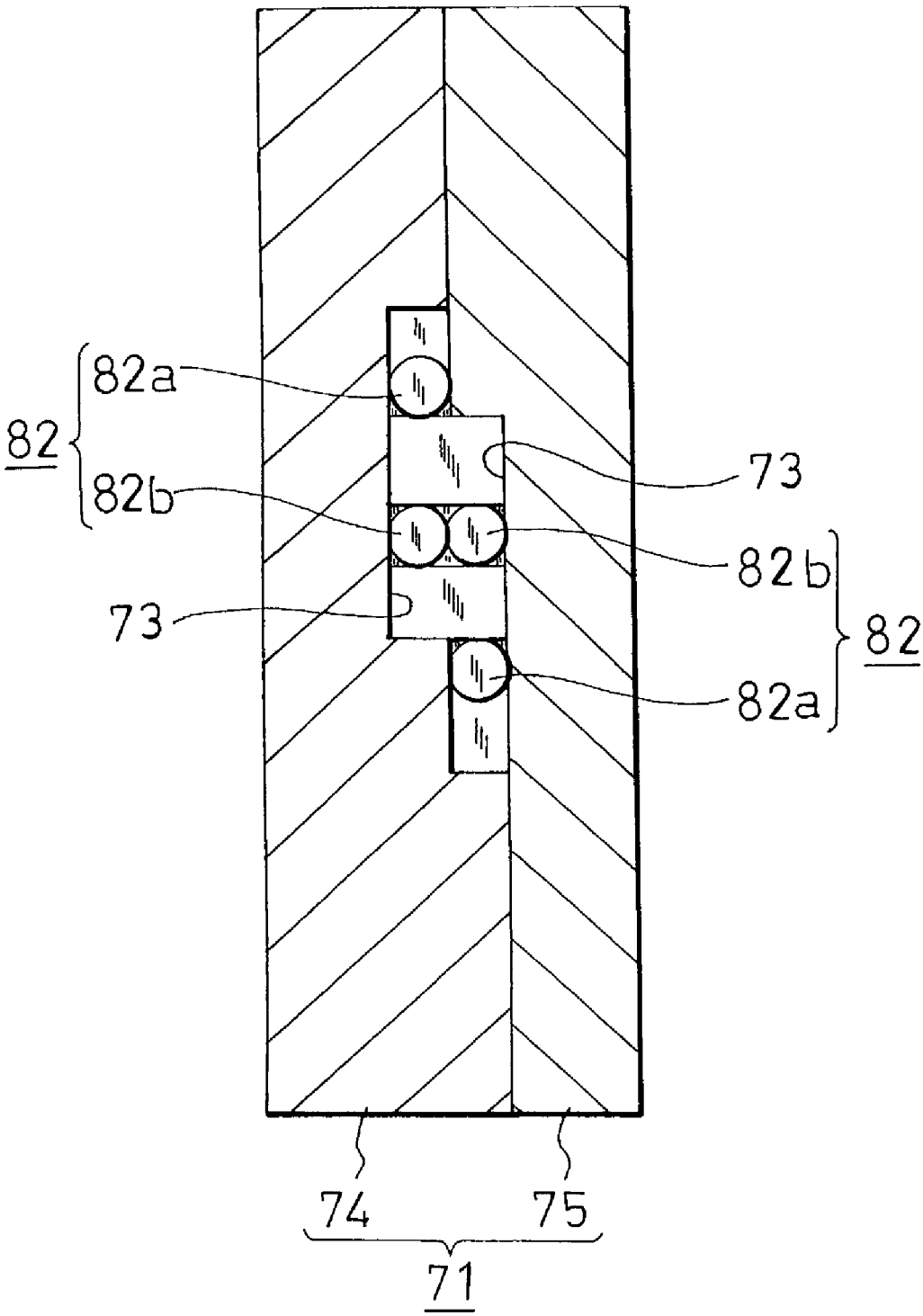
FIG. 11 is an enlarged section view taken along the line XI—XI of FIG. 7.

The pair of linear portions 82*a*, 82*b* of the one bent wire rod 81 forming the locking member 80 are fitted in a rattle-free condition into the lower two retention grooves 77, 78 which are adjacent to each other, to be retained thereby. The two latch portions 85, 85 of the bent wire rod 81 are fitted into the latch groove 76 to be held so as not to longitudinally rattle. The pair of linear portions 82*a*, 82*b* which elongate from the latch portions 85, 85 are in contact with the guide face 73 so as to be vertically slidable. Tip end portions of the linear portions 82*a*, 82*b* protrude together with the mountain-like engaged portion 84, in front of the butting surface 72 which is formed by the front end face of the case 71. Furthermore, the pair of linear portions 82*a*, 82*b* of the other bent wire rod 81 forming the locking member 80 are fitted in a rattle-free condition into the upper two retention grooves 78, 79 which are adjacent to each other, to be retained thereby. The two latch portions of the bent wire rod 81 are fitted into the latch groove 76 to be held so as not to longitudinally rattle. The pair of linear portions 82*a*, 82*b* which elongate from the latch portions are in contact with the guide face 73 so as to be vertically slidable. Tip end portions of the linear portions 82*a*, 82*b* protrude together with the mountain-like engaged portion 84, in front of the butting surface 72 which is formed by the front end face of the case 71. In the center retention groove 78 of the three retention grooves 77, 78, 79, as shown in FIG. 10, the linear portions 82*b*, 82*b* of the other one of the paired bent wire rods 81 are placed so as to overlap each other in the width direction of the enclosure 10 (see FIG. 6). Similarly, as shown in FIG. 11, the linear portions 82*b*, 82*b* are overlappingly placed between the right and left guide faces 73. As shown in FIG. 7, the mountain-like engaged portion 84 of the lower bent wire rod 81 protrudes downward in the thickness direction of the enclosure 10 shown in FIG. 6, and the mountain-like engaged portion 84 of the upper bent wire rod 81 protrudes upward in the thickness direction of the enclosure 10 shown in FIG. 6. In the case 71, a space which strainlessly enables the above-mentioned displacement of the arm portion 82 in the vertical direction (the thickness direction of the enclosure 10) is ensured.

Figure 13:
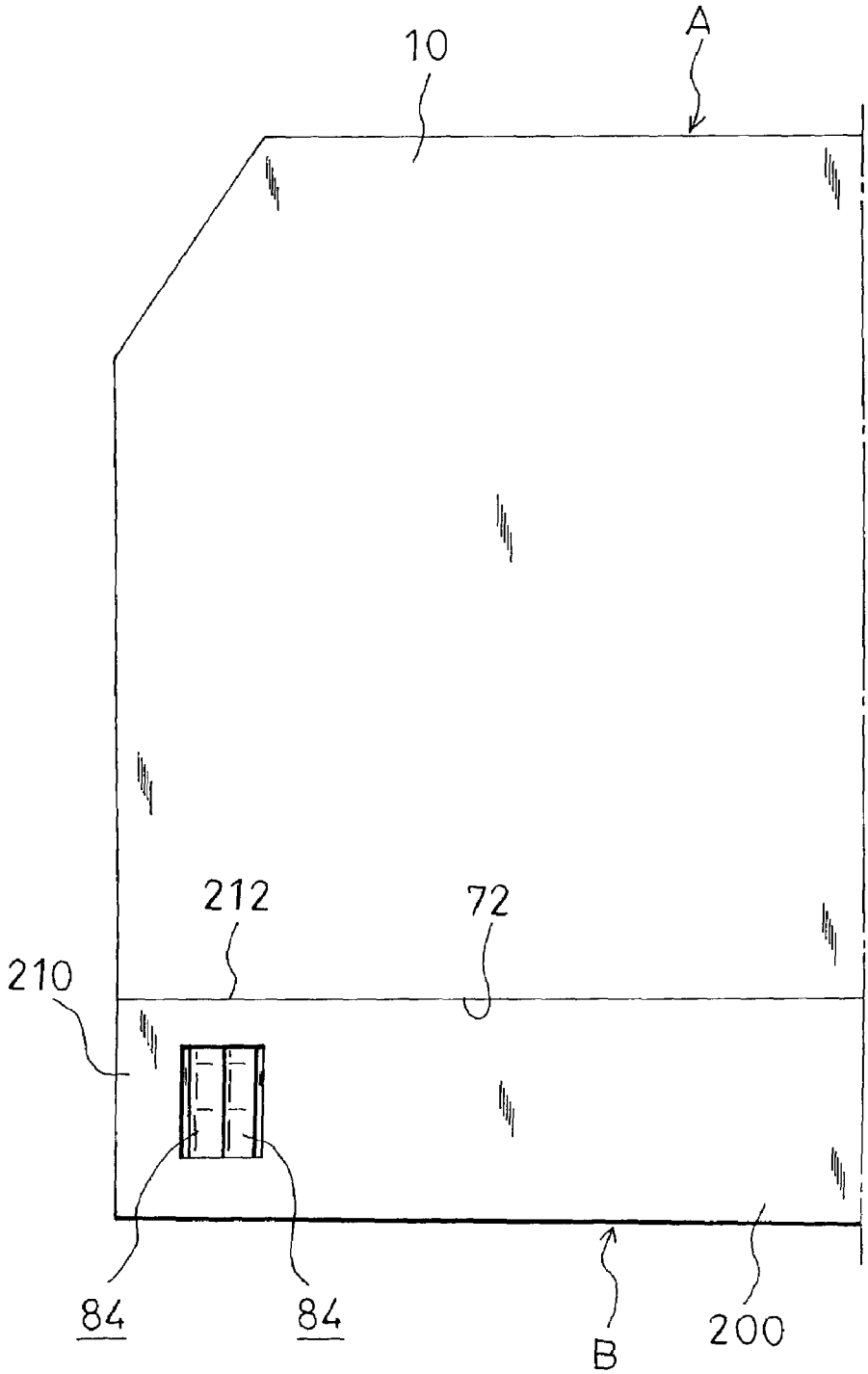
FIG. 13 is a partial plan view of the plug type connector which is joined to a counter connector.
Figure 14:
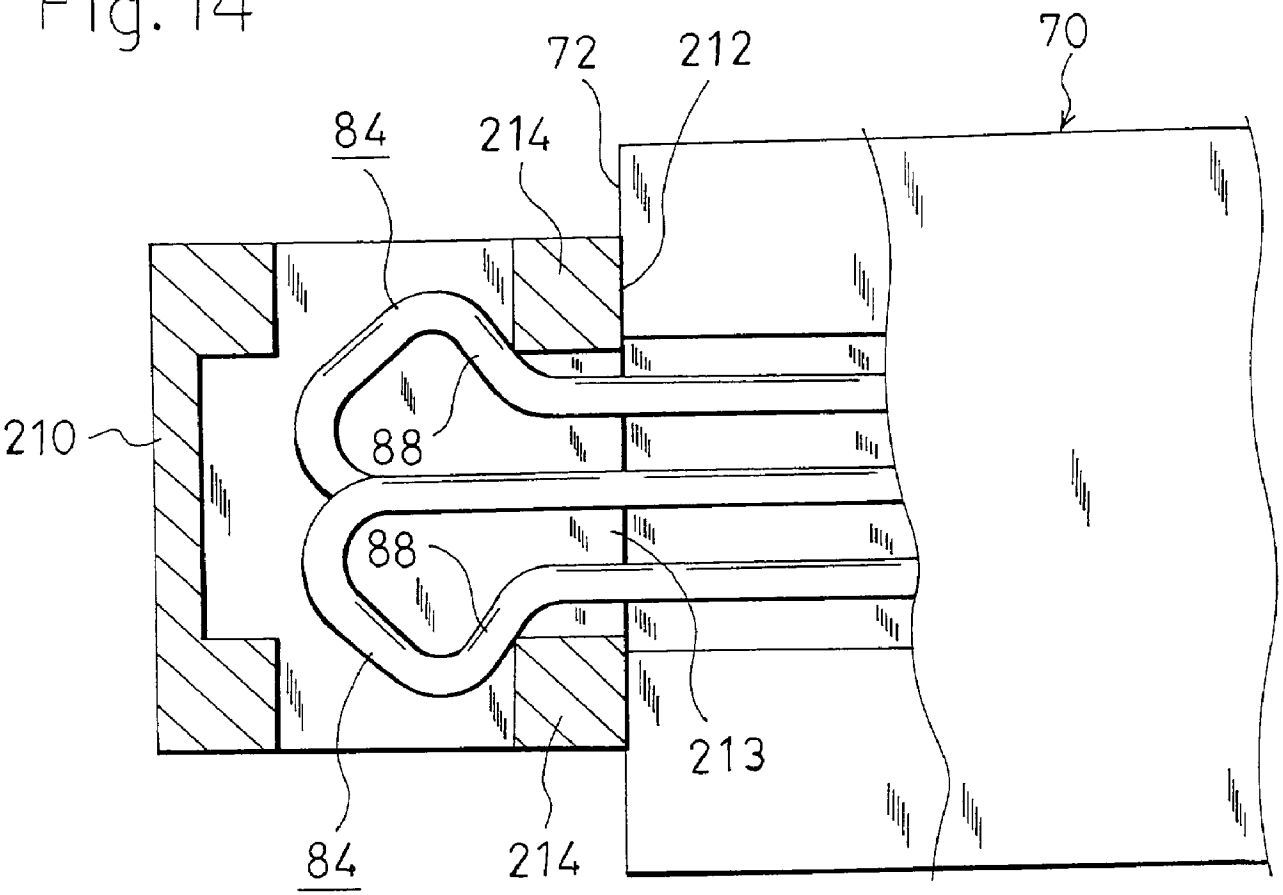
FIG. 14 is a partially cutaway side view illustrating a locked state.
Figure 15:
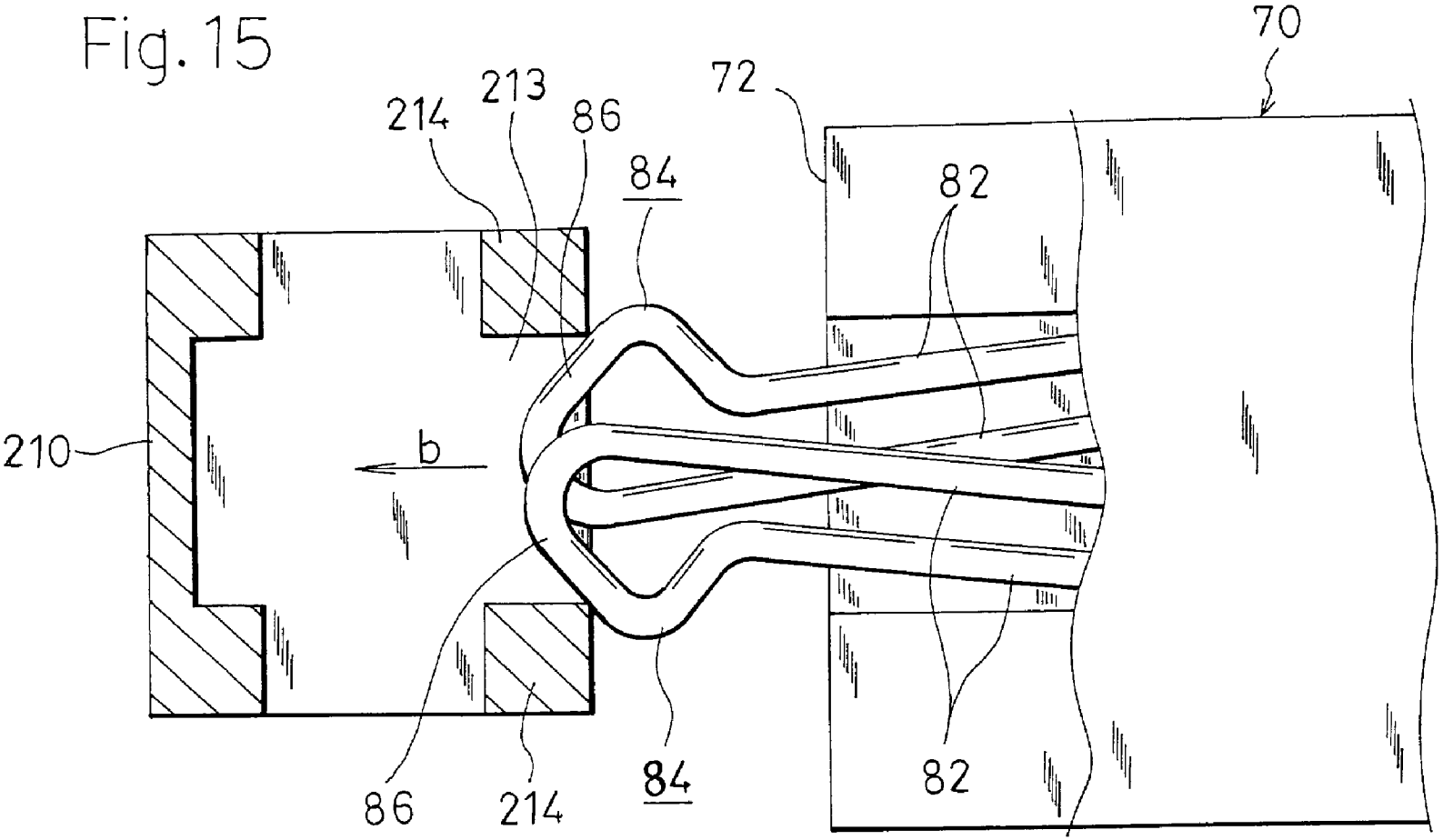
FIG. 15 is a partially cutaway side view illustrating an initial stage of an operation of engaging an engaged portion with an engagement portion.
Figure 16:
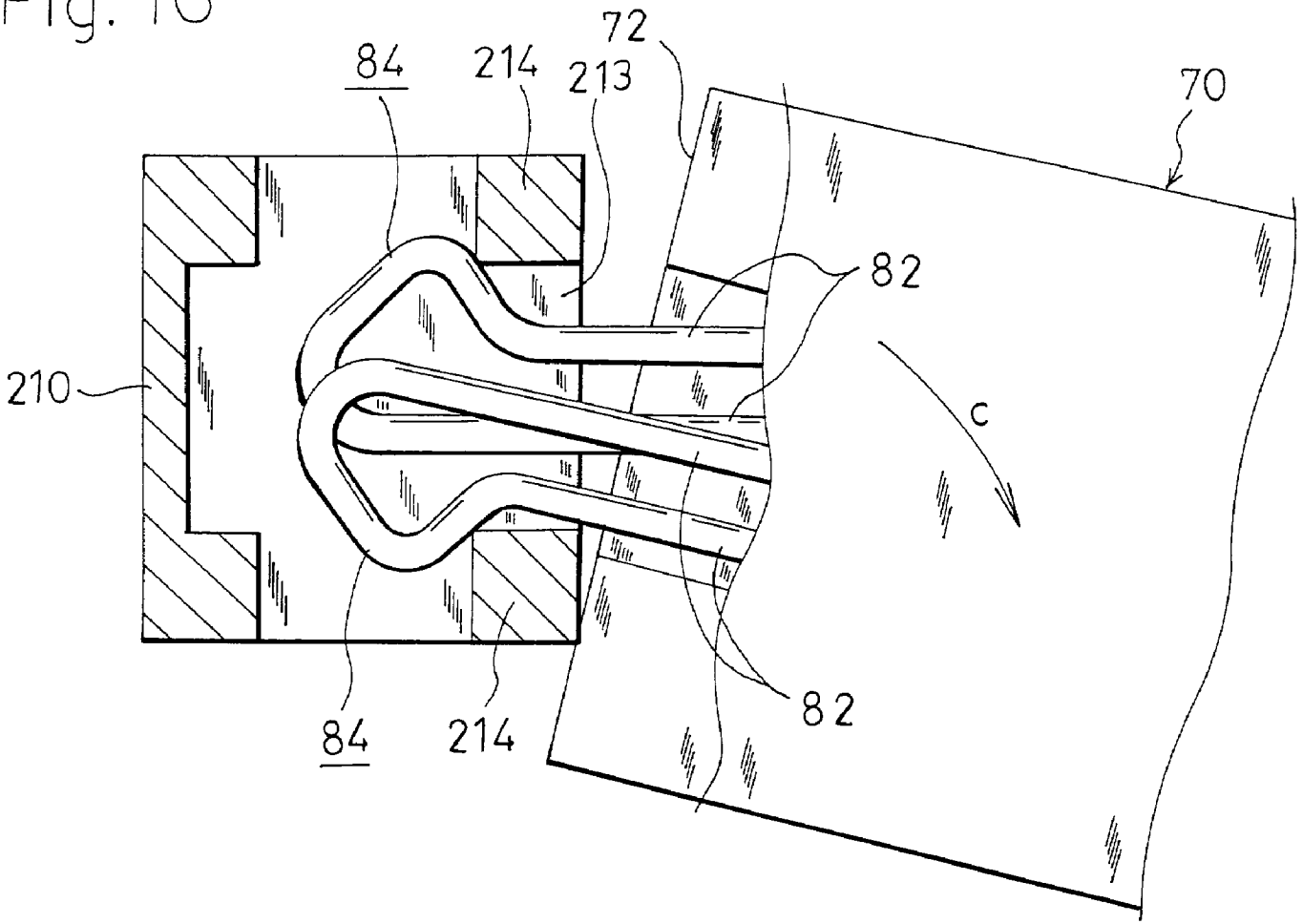
FIG. 16 is a partially cutaway side view illustrating a function in the case where a prying force is applied.

FIG. 13 shows the jack type connector B which is the counter connector. In the illustrated jack type connector B, an insertion space (not shown) into which the row of the contact portions 20 of the plug type connector A is to be inserted, and terminals (not shown) which are to be in contact with the row of the contact portions 20 are disposed in a laterally oblong hollow enclosure 200. Lock portions 210 are disposed on both the lateral sides of the insertion space, respectively. The engaged portions 84 of the pair of lock units 70, 70 (see FIG. 6) disposed on both the sides of the plug type connector A are to be inserted into and extracted from the lock portions, respectively. As shown in FIGS. 14 to 16, each of the lock portions 210 comprises: a receiving face 212 which is flush with an end face of the enclosure 200 shown in FIG. 13; and a pair of upper and lower engagement portions 214, 214 which are formed by upper and lower portions of the opening edge of a vertically oblong opening 213. The region behind the engagement portions 214, 214 is hollowed.

Next, the operation will be described with reference to FIGS. 14 to 16. In the following description of the operation, only the lock unit 70 on one side will be described. The lock unit 70 on the other side operates in parallel with the lock unit on the one side, and hence its description is omitted.

After the plug type connector A is opposed to the jack type connector B, the row of the contact portions 20 (see FIG. 1) is straightly inserted into the front of the vertically oblong opening 213 of the jack type connector B. As indicated by the arrow b of FIG. 15, the front inclined parts 86, 86 of the upper and lower engaged portions 84, 84 of the locking member 80 are then pressed from the outside against the upper and lower engagement portions 214, 214, and slide over the engagement portions 214, 214 to cause the engaged portions 84, 84 to override the engagement portions 214, 214 and reach the inner sides of the engagement portions 214 while flexurally deforming the arm portions 82, 82. When the engaged portions 84, 84 override the engagement portions 214, 214 and reach the inner sides of the engagement portions, the butting surface 72 butts against the receiving face 212 as shown in FIG. 14, and the rear inclined parts 88, 88 of the engaged portions 84, 84 are in elastic contact with the engagement portions 214, 214, so that the engagement portions 214, 214 are clampingly pressed between the engaged portions 84, 84 and the butting surface 72. As a result, the plug type connector A is connected to the jack type connector B in a rattle-free condition. This state is the locked state.

When the locked state of FIG. 14 is to be cancelled to disconnect the plug type connector A from the jack type connector B, the enclosure 10 or 200 of the plug type connector A or the jack type connector B is pulled in the direction along which the enclosures are separated from each other. When this disconnection operation is performed, the enclosure 10 of the plug type connector A is pulled in the direction along which the enclosure is separated from the engagement portions 214, 214. Therefore, the rear inclined parts 88, 88 of the engaged portions 84, 84 slide over the engagement portions 214, 214 to guide the engaged portions 84, 84 to the outer sides of the engagement portions 214, 214 while flexurally deforming the arm portions 82, 82. As a result, the locked state is cancelled, and the plug type connector A is disconnected from the jack type connector B.

By contrast, when the plug type connector A is pried in the direction of the arrow c in FIG. 16 during a work of canceling the locked state of FIG. 14, for example, the rear inclined part 88 of one of the engaged portions 84 slides over the engagement portion 214 to guide the engaged portion 84 to the outer side of the engagement portion 214 while flexurally deforming the arm portion 82. As a result, the locked state is cancelled, and the plug type connector A is disconnected from the jack type connector B. Therefore, a situation where the prying force is applied to the enclosure 200 of the jack type connector B, the engagement portion 214 of the lock portion 210, or the like and such a component is broken does not occur.

The displacement direction of the arm portion 82 which is elastically deformed in accordance with connection or disconnection of the plug type connector A with respect to the jack type connector B is restricted to the thickness direction of the enclosure 10 by the guide face 73 which has been described with reference to FIG. 7 or 11. Therefore, the operations of engagement and disengagement of the engagement portion 214 and the engaged portion 84 are stably performed. Since the engaged portion 84 is produced by bending a metal wire rod having a circular section shape into a mountain-like shape, there is no edge in the engaged portion 84 itself. When the engagement portion 214 and the engaged portion 84 are to be engaged with or disengaged from each other, therefore, a situation where the engaged portion 84 shaves the engagement portion 214 or the lock portion 210 does not occur. As a result, even when engagement and disengagement of the engagement portion 214 and the engaged portion 84 are frequently repeated, the stability of the locked state due to the portions is not impaired by the repetition.

In the embodiment described above, the enclosure 10 is equipped with the locking members 80 by installing the lock units 70 into the enclosure 10 of the plug type connector A. Alternatively, this can be realized by employing a structure in which the locking members 80 is directly installed into the enclosure 10. In this case, it is possible to employ a structure in which the locking members 80 are installed into the enclosure 10 by pressingly inserting the members into install areas that are formed by partitioning the enclosure 10.

The entire disclosure of Japanese Patent Application No. 2001-235127 filed on Aug. 2, 2001 including specification, claims, drawings and summary are incorporated herein by reference in its entirety.

The entire disclosure of Japanese Patent Application No. 2001-238692 filed on Aug. 7, 2001 including specification, claims, drawings and summary are incorporated herein by reference in its entirety.

What is claimed is:

1. A plug type connector, comprising:

a contact portion for electrical connection to a counter connector, said contact portion having two sides;

an elastic locking piece placed on each of said two sides of said contact portion, said elastic locking piece being engaged with and disengaged from an engagement portion of the counter connector; and a press operating member which presses said elastic locking piece positioned in a position of engagement with the engagement portion of the counter connector in a direction along which said elastic locking piece approaches said contact portion, whereby said elastic locking piece is displaced against resiliency to a position of disconnection from the engagement portion of the counter connector, wherein:

said elastic locking piece is configured from a synthetic resin molded product having an elastic, slender arm portion that is flexurally deformable, and a latch portion that is to be engaged with and disengaged from the engagement portion of the counter connector by means of flexural deformation of said arm portion;

a backup member placed behind said arm portion, and which has resiliency for defining a level of an operation load that is required for supporting and flexurally deforming said arm portion; and resilient force of said backup member is defined by adjusting an area of a contact surface with respect to said arm portion.

2. The plug type connector as defined in claim 1, wherein:

a deformation load for producing the flexural deformation of said arm portion is set to be smaller than the operation load, by selecting a thickness of said arm portion, and an insufficiency of the deformation load with respect to the operation load is compensated for by a resilient force of said backup member.

3. The plug type connector as defined in claim 1, wherein:

said backup member is configured from a plate piece of synthetic resin molded product.

4. The plug type connector as defined in claim 1, wherein:

said backup member is configured from a plate piece of elastomer.

5. The plug type connector as defined in claim 1, wherein:

said contact portion and said elastic locking piece are accommodated in a common enclosure said enclosure having lateral sides;

said press operating member is attached to each lateral side of said enclosure; and said enclosure has a wall face which overlaps with a back face of said backup member, and a concave or convex backup member holding portion to which said backup member is to be fitted or detached.

* * * * *